US005280930A

United States Patent [19]

Smathers et al.

[11] Patent Number: 5,280,930

[45] Date of Patent: Jan. 25, 1994

[54] HYDRAULIC BRAKING SYSTEM FOR IN-LINE ROLLER SKATES

[75] Inventors: David R. Smathers, 200 W. Arlington, Gladstone, Oreg. 97027; Jeffrey A. Smathers, San Jose, Calif.

[73] Assignee: David R. Smathers, Gladstone, Oreg.

[21] Appl. No.: 934,023

[22] Filed: Aug. 21, 1992

[51] Int. Cl.[5] ..... A63C 17/14

[52] U.S. Cl. ..... 280/11.2; 280/11.22

[58] Field of Search ..... 280/11.2, 11.22, 11.19, 280/11.23, 842, 87.041, 87.042; 188/344

[56] References Cited

U.S. PATENT DOCUMENTS 4,943,075 7/1990 Gates ..... 280/11.2

5,143,387 9/1992 Colla ..... 280/11.2

FOREIGN PATENT DOCUMENTS 1015536 10/1952 France ..... 280/842

*Primary Examiner*—Richard M. Camby

*Attorney, Agent, or Firm*—Chernoff, Vilhauer, McClung & Stenzel

[57] ABSTRACT

A braking system for in-line roller skates includes a hand-held brake actuator coupled to a plurality of brake assemblies by a conduit system. The brake assemblies are mounted on a housing beneath the boot portion of the roller skate adjacent selected ones of the rollers. The conduit system supplies hydraulic fluid to the brake assemblies which apply frictional pressure to the side walls of the rollers thus stopping the skates.

18 Claims, 3 Drawing Sheets

HYDRAULIC BRAKING SYSTEM FOR IN-LINE ROLLER SKATES

BACKGROUND OF THE INVENTION

The following invention relates to a braking system for roller skates and in particular to a hydraulic braking system for use with roller skates of the in-line variety.

In recent years in-line roller skates have achieved great popularity. Such skates are characterized by a plurality of rollers mounted at the bottom of a shoe or boot where the rollers are situated one behind the other along the directional line of travel of the skate. Thus, the rollers appear to simulate the blade of an ice skate. Such skates are marketed under the brand name ROLLERBLADE TM.

A problem common to all types of roller skates, including in-line roller skates and skateboards, is the difficulty in slowing down. Thus, various braking systems have been proposed for roller skates and skateboards but none are entirely satisfactory. Conventional braking systems for skateboards which use a foot actuated brake which applies a frictional member against a roller are shown in Waddel U.S. Pat. No. 3,385,608, Sakwa U.S. Pat. No. 3,288,251, and Maurer U.S. Pat. No. 4,003,582. The aforementioned systems use some type of leveraged brake pad bearing directly against a roller or wheel and controlled through a foot actuated mechanical link. While such systems may be practical for skateboards where the user has the ability to shift foot position from one point to another on the skateboard, such a system is not practical for roller skates where the user's feet are encased in special boots.

A hand actuated hydraulic system for a skateboard is proposed in Dungan U.S. Pat. No. 4,295,547. The Dungan system, however, is uniquely adapted for use on skateboards, with side-by-side roller pairs and in order to work properly, requires a special outer stationary brake assist.

SUMMARY OF THE PRESENT INVENTION

The present invention provides a braking system for in-line roller skates of the type in which each roller skate includes a plurality of rollers situated one behind the other along a line of directional travel of the skate. A hand operated hydraulic actuator is coupled to each of the roller skates by a hydraulic conduit system and each of the skates includes at least one hydraulic brake for at least one of the rollers.

Preferably, a plurality of hydraulic brakes, one for each roller, are connected in series and the brakes on both roller skates are controlled by the hand-held hydraulic actuator through a Y or T coupling that includes two output lines connected to each of the roller skates. The Y coupling can be held against the user's body by a belt or the like at the small of the back so that the hydraulic lines emanating from the coupling may extend down along the backs of the user's legs to each respective roller skate.

The hand-held actuator may comprise a pistol grip and lever combination in which the lever actuates a hydraulic cylinder to pump hydraulic fluid to the brakes.

As is conventional with roller skates of this type, the individual rollers are mounted on axial shafts which extend between the walls of a housing which extends vertically along either side of the sidewalls of the rollers. Each of the hydraulic brakes includes a hydraulic cylinder and piston which may be contained in an enclosure mounted on the axial shaft supporting each roller. Each piston is coupled to a caliper which extends through the wall of the housing to apply frictional pressure to a roller. A brake pad mounted on the axial shaft interiorally of the housing includes a semi-flexible member situated between the brake caliper and a sidewall of the roller so that the caliper bears against the brake pad thereby forcing it against the sidewall of the roller.

Each brake pad includes a splined spacer portion so that the pads may be mounted around the axial shaft supporting each roller. The splined spacer portion fits into a corresponding recess in the interior of the housing, and prevents rotation of the brake pad about the roller axis.

The hydraulic brake assemblies are contained in an enclosure which includes a flange having an aperture for mounting on the axial shaft. In this way the hydraulic brakes of the invention may be provided as a retrofit kit for existing in-line skates with a minimum of modification to the existing structure of the skate.

Typically in-line roller skates include four rollers mounted in a single directional line. Preferably, the braking system of the invention includes four hydraulic brakes for each skate, that is, one for each roller, connected in series, thus assuring that braking pressure is applied uniformly to all rollers simultaneously.

It is a primary object of this invention to provide a hydraulic braking system for in-line roller skates.

It is a further object of this invention that the braking system for in-line roller skates be operated by a hand-held actuator.

DETAILED DESCRIPTION OF THE PREFERRED EMBODIMENT

Figure 1:
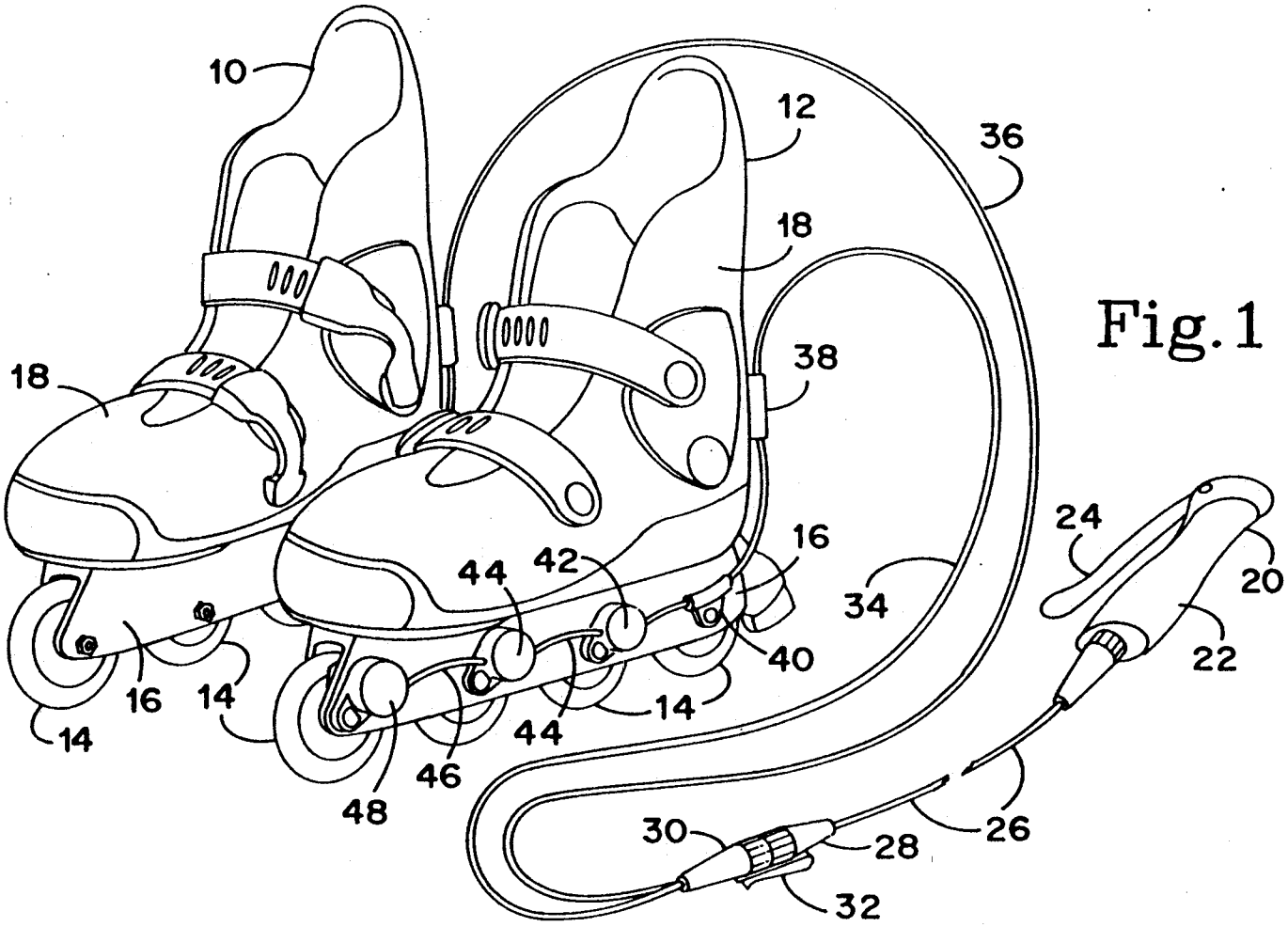
FIG. 1 is a perspective view of a hydraulic braking system for a pair of in-line roller skates.

A braking system for a pair of in-line roller skates is provided for a pair of roller skates 10 and 12. These roller skates are of the in-line variety commonly sold under the trade name ROLLERBLADE TM. As such the skates 10 and 12 each include a plurality of rollers 14 arranged in a straight line along the direction of travel of the skate. The rollers are located underneath the skate 12 in a housing 16 which is fastened to the bottom of a boot 18.

The braking system of the invention includes a hand-held hydraulic actuator 20 which includes a hydraulic cylinder (not shown) which is internal to a pistol-grip handle portion 22. The hydraulic cylinder is worked by a lever 24 which is coupled to the handle portion 22. The actuator 20 and the hydraulic cylinder is in essence a hydraulic pump which pumps hydraulic fluid through a conduit 26 to a Y coupler 28. The Y coupler 28 is contained in a housing 30 which may be affixed to the wearer's belt or the like near the small of the back or on the side by a clip 32. The outputs of the Y coupler 28 are a pair of hydraulic lines 34 and 36 which are connected to the skates 12 and 10, respectively.

With particular reference to the roller skate 12 (the roller skate 10 is constructed in an identical fashion) the hydraulic conduit is secured to the back of the boot portion 18 by a guide 38, and thence routed to a second guide 40 situated along the outside of the housing 16. The conduit is then coupled into a first hydraulic brake assembly 42.

As will be explained below the hydraulic cylinders in each of the hydraulic brake assemblies such as brake 42 are coupled in series by short conduits extending from one brake to the next. A hydraulic conduit 44 connects hydraulic brake 42 to hydraulic brake 44 and a similar short conduit 46 connects hydraulic brake 44 to hydraulic brake 48. Thus, a plurality of hydraulic brakes, each associated with one of the rollers 14, are affixed to the outside of the housing 16 and are connected hydraulically in series. Preferably, there should be one brake assembly for each roller in the roller skate and there are typically four rollers for each skate. However, if desired, fewer brake assemblies than the number of rollers may be used. For example, FIG. 1 shows three brake assemblies associated with the first three rollers of the in-line skate 12.

Figure 2:
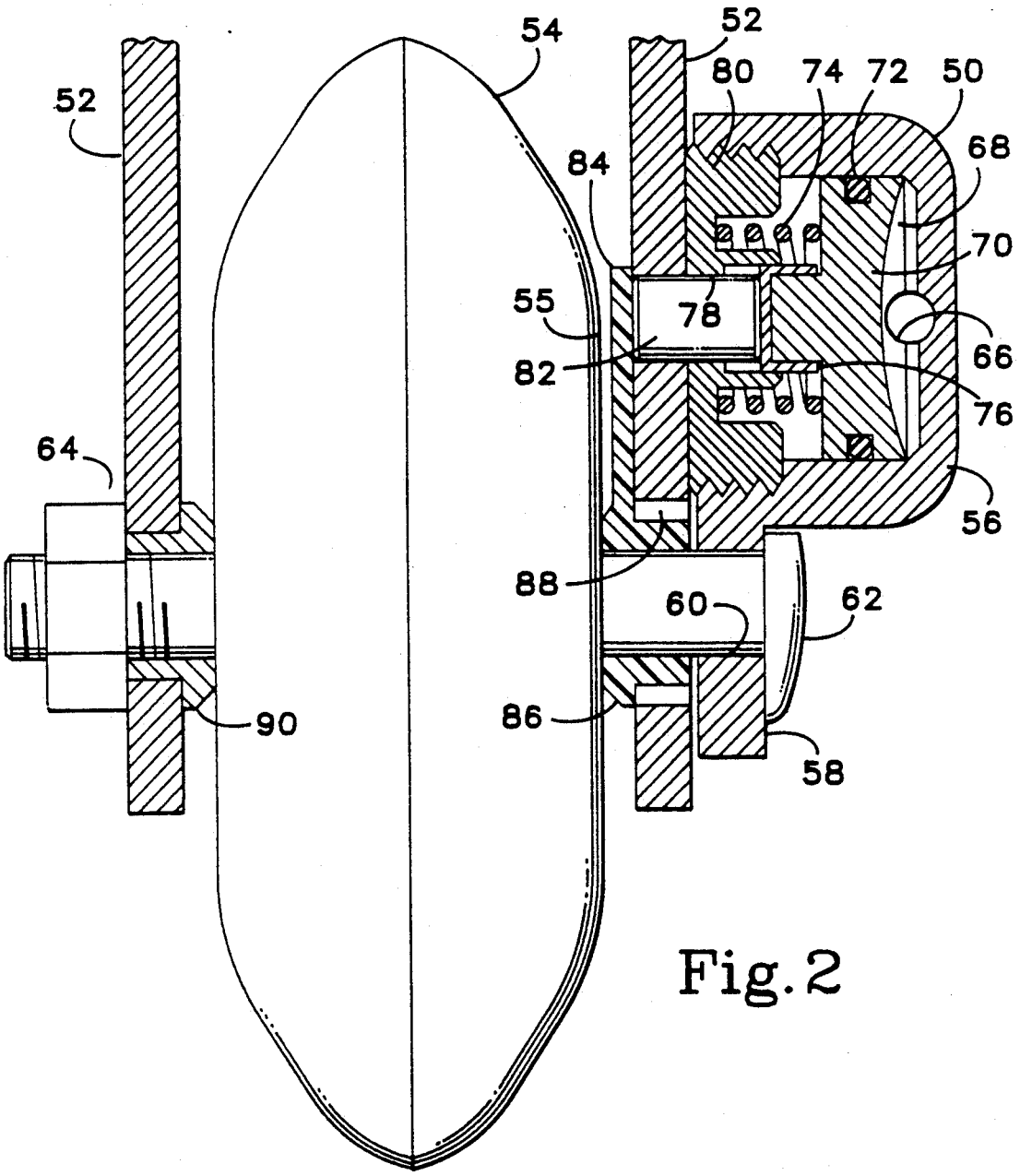
FIG. 2 is a partial cutaway front elevation view of a hydraulic brake assembly applied to one of the rollers of an in-line roller skate.

Referring now to FIG. 2 a hydraulic brake assembly 50 is affixed to a roller skate housing 52 which includes a roller 54. The hydraulic brake assembly 50 includes an outer cup-like enclosure 56 having a flanged portion 58. This enclosure is threadingly mated to an interior central portion 80. The flanged portion 58 includes an aperture 60 so that the hydraulic brake assembly 50 may be affixed to the outside of the housing 52 by a bolt 62. The bolt 62 extends through the housing 52 on either side thereof and is secured by a nut 64. The bolt 62 also provides the axial shaft for mounting the roller 54.

The hydraulic brake 50 includes an inlet aperture 66 coupled to a hydraulic fluid conduit (not shown in FIG. 2). This aperture communicates with a cylinder 68 which is the hollow interior of the cup-like enclosure 56. A piston 70 is disposed within the cylinder 68 and includes an 0-ring 72 for ease of movement along the cylinder wall. The cylinder 70 is normally outwardly biased by a spring 74. The piston 70 includes a forward reinforced tip portion 76 that slides within an internal cylinder 78. The internal cylinder 78 is part of the internal threaded central portion 80.

The piston 70 bears against a brake caliper 82 which extends through an aperture in the housing 52 to press against a brake pad 84. Under pressure from the caliper 82 the brake pad 84 frictionally engages a sidewall 55 of the roller 54. The caliper 82 is provided so that a long piston will not be required. Because of the shearing force acting at right angles to the piston when pressure is applied, an elongate piston may tend to bind up. This is less likely with the shorter brake caliper 82.

Figure 3:
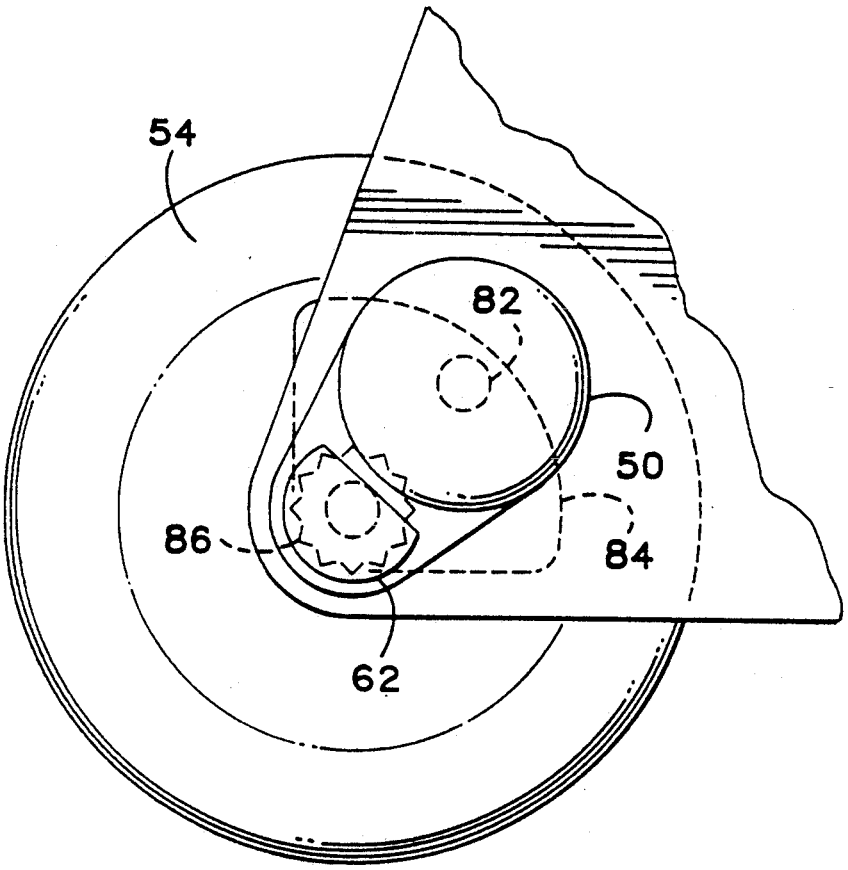
FIG. 3 is a partial side elevation view of a roller skate housing with an attached hydraulic brake assembly.

Referring now to FIG. 3, the brake pad 84 is a semi-flexible, quarter circle, wedge-shaped member which includes a splined spacer portion 86. The brake pad is preferably made from a composite carbon/kevlar-/epoxy material. Referring once again to FIG. 2, the splined spacer portion 86 fits into a similarly shaped cutout portion 88 of the housing 52. The roller 54 is held away from the housing wall on the opposite side by a spacer 90. The splined spacer portion 86 of the brake pad serves to prevent rotation of the brake pad around the roller axis.

While the preferred embodiment of the brake pad includes a splined spacer portion 86, it should be recognized that other shapes may be used since the purpose is to prevent the rotation of the brake pad around the roller axis as a result of either roller rotation or pressure from the brake caliper 82. In conventional in-line roller skates, the spacers on either side of the roller which serve to separate the walls of the roller from the interior walls of the housing are keyed to interior recesses in the housing to prevent rotation of the spacers. Commonly the spacer may include, for example, an oval portion that fits into an oval shaped recess in the housing wall. One particular advantage of the invention described herein is that it may be used as a retrofit kit and applied to existing in-line skates. In such a case the brake pad will include a spacer portion that is shaped to fit the particular keyed configuration of the interior of the housing wall to prevent its rotation. One advantage of the splined version of the brake pad shown herein is that when one portion of the brake pad wears out, the pad may be rotated slightly by shifting the splines to the next corresponding set of notches in the interior housing wall. Thus, the brake pads are shaped as 90° wedges, and the position of the pads may be changed several times before the entire pad wears out and must be replaced.

It will be appreciated that there may be other variations of the hydraulic braking system shown herein without departing from the spirit of the invention. While the series connected hydraulic brakes disclosed are particularly advantageous for use as a retrofit system, other types of hydraulic brakes located interiorally of the housing could be used. If the braking system were built into the housing, brake pressure could be applied from the top directly down on the outer surface of the roller and not against its sidewall. In addition it may be advantageous to apply braking pressure from both sides of the roller instead of just one and in such cases there could be two sets of hydraulic brakes, one on either side of the roller. As a further variation, a pincer-type of brake could be built into the boot.

In addition, other types of hand held hydraulic actuators could be used. While what has been shown is a conventional pistol grip and lever type of hand held actuator, other types, including a button or plunger type, could be employed.

Although the invention has been described with reference to hydraulic brakes it is possible that other equivalent types of braking systems could be employed. For example, pneumatic systems using air or other gasses could be used. It may also be possible to adapt wire-driven brakes such as those used on bicycles or even electric brakes to the configuration of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A braking system for a pair of in-line roller skates, each roller skate including a plurality of rollers situated one behind the other along a line of directional travel of the skate comprising:

a. a single hand operated actuator;

b. a hydraulic conduit system coupling the actuator to each of said pair of roller skates, said conduit system including a coupling comprising an input from said actuator and two hydraulic output lines; and c. at least one hydraulic brake assembly located on each of said roller skates and coupled to each respective one of said hydraulic output lines for applying braking force to at least one of said rollers on each of said roller skates simultaneously.

2. The braking system of claim 1 wherein a plurality of hydraulic brake assemblies is provided for each of said roller skates.

3. The braking system of claim 2 wherein each of the brake assemblies in each said plurality are connected in series.

4. The braking system of claim 1 wherein the hand operated hydraulic actuator includes a pistol grip portion and a lever portion coupled to a hydraulic cylinder.

5. The braking system of claim 1 wherein the hydraulic brake assembly includes a hydraulic cylinder and a piston contained in an enclosure mounted on an axial shaft supporting a roller.

6. The braking system of claim 5 wherein the piston is coupled to an engagement caliper that extends through a wall of a housing supporting the rollers to apply frictional pressure to a roller.

7. The braking system of claim 6, further including a brake pad mounted on the axial shaft and having a semi-flexible member situated between the engagement caliper and a sidewall of a roller.

8. The braking system of claim 1 wherein said coupling comprises a Y coupling adapted to be worn on the body of the user.

9. In a roller skate, the roller skate including at least one roller having a sidewall and mounted in a housing on an axial shaft extending through the housing, a hydraulic brake comprising:

(a) a hydraulic cylinder and piston mounted on said housing; and (b) a brake pad comprising a semi-flexible member extending between the piston and said sidewall of the roller and bearing against said sidewall in response to pressure from said piston.

10. The hydraulic brake of claim 9 wherein said piston means includes an engagement caliper that extends through an aperture in said housing to bear against said brake pad.

11. The hydraulic brake of claim 9 wherein said brake pad includes a spacer portion journaled onto said shaft and a friction pad portion extending into a space adjacent said aperture between said housing and said sidewall of said roller.

12. The hydraulic brake of claim 11 wherein said brake pad spacer portion includes a splined portion cooperatively mating with an interior portion of said housing.

13. The hydraulic brake of claim 11 wherein said piston and cylinder are contained in an enclosure affixed to the outside of the housing.

14. The hydraulic brake of claim 13 wherein said enclosure includes a flanged portion journaled onto said shaft.

15. In a pair of in-line roller skates, each skate having a first plurality of rollers arranged in a single straight line, a braking system including a single hand-held brake actuator coupled in parallel to a pair of brake assemblies, one such brake assembly for selected ones of said first plurality of rollers on each skate, wherein each of said brake assemblies are actuated simultaneously by said hand-held brake actuator.

16. The braking system of claim 15 wherein said pair of brake assemblies are hydraulic brake assemblies.

17. The braking system of claim 15 wherein said brake assemblies are mounted on a roller housing supporting said first plurality of roller substantially adjacent each selected ones of said rollers.

18. The braking system of claim 15 further including a Y coupling connected between said single hand-held brake actuator and said pair of brake assemblies.

* * * * *

UNITED STATES PATENT AND TRADEMARK OFFICE

CERTIFICATE OF CORRECTION

PATENT NO. : 5,280,930
DATED : January 25, 1994
INVENTOR(S) : David R. Smathers

It is certified that error appears in the above-indentified patent and that said Letters Patent is hereby corrected as shown below:

Column 6, line 34 (Claim No. 17) delete "roller" and insert --rollers--.

Signed and Sealed this

Second Day of August, 1994

*Attest:*

Bruce Lehman

BRUCE LEHMAN

*Attesting Officer*

*Commissioner of Patents and Trademarks*